US006889775B2

(12) United States Patent
Shaw et al.

(10) Patent No.: US 6,889,775 B2
(45) Date of Patent: May 10, 2005

(54) RETROFITTED NON-HALON FIRE SUPPRESSION SYSTEM AND METHOD OF RETROFITTING EXISTING HALON BASED SYSTEMS

(75) Inventors: Bon F. Shaw, Independence, MO (US); Bradford T. Stilwell, Blue Springs, MO (US); John K. Schaefer, Gladstone, MO (US); Paul H. Kohne, Blue Springs, MO (US)

(73) Assignee: Fike Corporation, Blue Springs, MO (US)

( * ) Notice: Subject to any disclaimer, the term of this patent is extended or adjusted under 35 U.S.C. 154(b) by 223 days.

(21) Appl. No.: 10/224,681

(22) Filed: Aug. 20, 2002

(65) Prior Publication Data

US 2004/0045725 A1 Mar. 11, 2004

(51) Int. Cl.[7] ..... A62C 31/00

(52) U.S. Cl. ..... 169/46; 169/9

(58) Field of Search ..... 169/5, 9, 46, 47, 169/71, 84–88

(56) References Cited

U.S. PATENT DOCUMENTS 6,112,822 A * 9/2000 Robin et al. ..... 169/46

* cited by examiner

*Primary Examiner*—Steven J. Ganey
*Assistant Examiner*—Thach H. Bui
(74) *Attorney, Agent, or Firm*—Hovey Williams LLP

(57) ABSTRACT

This invention relates to a method of converting Halon-based fire suppression systems by substituting HFC 125 for the Halon without the need for changing the in place existing distribution piping. An amount of HFC 125 greater than the amount of Halon utilized in the fire suppression system is provided, which is under a pressure to effect exhaustion of the HFC 125 of the system within a time range exceeding about 10 seconds and up to about 25 seconds and which meets the standard fire extinguishing requirements for Class A and Class B fires. An existing fire suppression system is analyzed for flow characteristics to find $T_D$ of that system. The greater quantity $C_+$ of HFC 125 required for the retrofitted system is determined by the formula $$C_+=((T_D-10)/(2\times T_{CRIT})-T_D\times 100) \text{ wherein } T_{CRIT}=0.Y\times(T_D-10)/(C_+/100))+T_D.$$

The method may also be utilized to determine the amount of HFC 125 required for the retrofitted fire suppression system.

11 Claims, 1 Drawing Sheet

RETROFITTED NON-HALON FIRE SUPPRESSION SYSTEM AND METHOD OF RETROFITTING EXISTING HALON BASED SYSTEMS

BACKGROUND OF THE INVENTION

1. Field of the Invention

This invention relates to a fire suppression system for enclosed spaces containing equipment, apparatus or materials that require protection from combustion hazards, such as a fire. In particular, the invention concerns an improved retrofitted fire suppression system and method in which the fire suppression agent is HFC 125 as a replacement for Halon 1301. The system and method also has utility for design and installation of new fire suppression equipment based on the use of HFC 125, in lieu of Halon.

Halon 1301 has long been used as a fire suppression agent for areas where utilization of water spray or mist, solid suppressants such as sodium bicarbonate, or liquified compressed carbon dioxide is precluded. Exemplary in this respect are rooms or enclosures containing computer or electronic equipment, which would be damaged by water impingement. Solid suppressant discharge is undesirable in these applications because of the powdered residue that would be left on such equipment. Carbon dioxide suppressant systems have the disadvantage that at levels of $CO_2$ adequate to suppress a fire, the resultant displacement of air is such that the environment would potentially be unsafe for individuals in the protected area.

2. Description of the Prior Art

It has been the practice for many years to protect sensitive equipment such as computer installations, electronic components, and materials or devices that would be damaged if subjected to fire suppressants such as water, or a solid agent. A common suppressant such as $CO_2$ is also ruled out because the carbon dioxide displaces air from the enclosed space to an extent that individuals in the protective zone are placed at risk for lack of required oxygen.

In order to meet the need for protecting computer rooms and the like from a fire hazard, it became the practice a number of years ago to use a fluorocarbon, such as Halon 1301 as the suppressant agent. Halon had the advantage of being storable as a liquid under pressure at room temperature and which vaporized to produce a fire suppressant gas when discharged into the enclosure or area to be protected. Halon 1301 was deemed to be a "clean" fire suppressant because upon discharge of the agent it did not damage the equipment being protected from a fire hazard. Furthermore, individuals were still able to breathe adequately in the room or enclosure into which the Halon was discharged because the suppressant agent was found to be effective at a concentration which would put out a fire in the enclosure while still leaving a breathable oxygen level in the protected area.

Because of the clean unique characteristics of Halon 1301 as a fire suppressant agent, which was effective at breathable concentrations, Halon suppressant agent installations became the de facto agent for all applications where discharge of water or solid suppressant, or use of $CO_2$ as a suppressant was undesirable or impractical. Halon-based suppressant systems have been installed throughout the United States and in many countries abroad.

In recent years, there has been mounting evidence that certain fluorocarbons, including Halon 1301, when discharged into the atmosphere tend to rise and accumulate in the stratosphere, thereby producing a deleterious hole in the ozone level over Antarctica creating undesirable global environmental effects. Because of mounting scientific evidence of the detrimental effect on the environment caused by certain fluorocarbons, such as Halon 1301, countries around the world have banded together and approved treaties either banning the use of Halon 1301, or imposing substantial surcharges on the purchase and use of Halon 1301 in new installations, or in recharging of existing fire suppressant systems. The goal of the largely successful treaties has been to coerce manufacturers and users to abandon use of Halon 1301 as a suppressant agent or at least substantially reduce the population of existing Halon 1301 installations.

Replacement or retrofitting of Halon 1301 fire suppressant systems has been impeded by the difficulty of developing a reasonable substitute for Halon 1301 which is as effective in suppressing fires, that can be made available at a non-prohibitive cost, and that negates the necessity of completely replacing the piping and distribution components of existing fire suppression systems. Noteworthy in this respect is the fact that in a significant proportion of Halon based fire suppression systems installed to protect electronic equipment such as computer components, the piping for the suppression system is located beneath the floor supporting the equipment requiring protection. It therefore is largely impractical to remove the computer equipment, tear up the floor and disconnect all of the wiring to the electronic components, merely for the purpose of replacing the fire suppression system piping.

One substitute fluorocarbon that offered promise as a replacement for Halon 1301 was FM-200®, available from Great Lakes Chemical Company. Principal disadvantages of the use of FM-200® have been the higher product cost, and the need to use a larger quantity of the agent as compared with Halon 1301 for a similar area to be protected. This larger amount of FM-200® required that the receptacles for storing the suppressant agent be larger than those typically used for Halon 1301 to protect the same area, and the FM-200® had different physical properties and flow characteristics which did not necessarily permit use of that agent in an existing fire suppression system without modification of the distribution components and nozzles of the system.

The need to repipe a protected area such as a computer room to replace an existing Halon system with an FM-2000® system presented such a formidable and expensive undertaking that many users elected not to do so and if recharging of the system with Halon was necessary, users decided to pay the necessary excise fees to buy a replacement amount of Halon 1301. The problem presented by Halon 1301 replacement is exacerbated by the fact that it is desirable that a system be tested by discharge of the Halon from time to time to verify the operability of the system and its effectiveness. Each time a test discharge is carried out, replacement Halon 1301 has to be purchased for recharging the system even though the Halon 1301 can be obtained only at what amounts to a largely prohibitive higher cost than the initial cost.

In certain jurisdictions, with Europe being a particular example, recently enacted legislation bars manufacture and sale of Halon 1301 for fire suppression applications in European Union countries. Therefore, replacement of Halon 1301 with a Halon recharge is simply not an option.

Halon 1301 has been stored as a pressurized gas within a pressure vessel in which pressurized nitrogen was contained in the vessel interior above the level of the liquified suppressant agent therein to assure complete delivery of the liquid suppressant agent through the system piping to the nozzles so that the time of discharge of the agent was maintained in the approved time range of 6 to 10 seconds.

Another fire suppressant fluorocarbon proposed as a substitute for Halon 1301 and that does not exhibit the undesirable ecological effects of Halon 1301 is HFC-125. However, use of HFC-125 also has the disadvantage vis a vis Halon 1301 of requiring delivery of a greater amount of the suppressant agent to meet standardized fire suppression tests.

The vapor pressure of Halon 1301 is about 200 psi. However, HFC-125 has a substantially lower vapor pressure, of the order of 125 psi. Accordingly, even if an atmosphere of relatively high pressure nitrogen is provided in overlying relationship to the pressurized liquified suppressant agent in the supply vessel as an aid in delivery of the liquified agent through the piping distribution array, HFC-125 will not flow through such piping at the same rate as is the case with Halon 1301. A HFC-125 system therefore inherently flows slower than a comparable Halon 1301 system.

As a consequence, the specific piping components and arrangement of a particular existing Halon 1301 fire suppression system have a different effect on the overall flow rate of HFC-125 as compared with Halon 1301 suppression agent. Elbows and tees in the piping system are known to have a pronounced effect on flow rates and how the liquid divides one way or the other at a bullhead or a side through tee. Simply adding additional pressure to the liquified HFC-125 in the storage vessel in the form of higher pressurized nitrogen, in an effort to solve the problem of the inherently slower flow rate of HFC-125 as compared with Halon 1301, is not feasible because of the problem of choked flow.

Computer programs have been developed and are available for evaluating the flow characteristics in specific storage vessels, piping and nozzle systems for delivery of liquified gaseous suppressant agents, including pressurized liquefied carbon dioxide, Halon 1301, HFC227ea (FM200) and HFC223 (FE13). The programs take into account factors such as pipeline pressure and agent density in the pipeline, pressure drop along the length of the piping system, turbulence, velocity changes, transients, mechanical effects on density and flow such as occur through an elbow, a bullhead tee or side-through tee, and the internal surface of the pipe sections and connectors. These computer programs have been used by installers of pressurized liquefied gaseous suppressant agents to determine the amount of a particular agent required for a given amount of area to be protected, the piping system necessary for such system, the number, size and location of nozzles and the pressurized nitrogen head required over the stored liquefied suppression agent.

The computer programs contained mathematical correlations and look up tables that gave the installer of a system substantial assurance full discharge of the liquefied suppression agent from the fire protection system would occur in a time range meeting approved regulations or standards, with a built in safety factor, usually in the range of about 20% in the United States to about 30% in Europe.

SUMMARY OF THE INVENTION

This invention relates to retrofitting of existing Halon 1301 charged fire suppression systems with HFC 125 as a fire suppressant agent for protecting a room or other enclosure containing equipment which cannot be subjected to conventional agents such as water from sprinklers, water in mist form, powdered suppressant solids or carbon dioxide.

Existing systems incorporating Halon 1301 as a fire suppressant agent have a pressure vessel or a series of such vessels for storing the suppressant agent in liquid form under a nitrogen head pressure. The storage devices are coupled to a piping system having a plurality of distribution pipes extending from the storage vessels to respective distribution nozzles extending into and strategically located about the enclosure or area to be protected from a fire hazard. Typically, sensors such as infrared or smoke detectors are provided in the room or enclosure for early detection of an event indicative of a conflagration. Upon sensing of an fire condition by one or more of the sensors, selectively actuatable closures normally blocking release of suppressant agent from the storage vessels are actuated, thereby permitting the stored pressurized Halon 1301 to flow as a liquid through the piping system for gaseous discharge through respective nozzles into the protective area.

Every burning material has a specific minimum requirement for fire suppression agent concentration for extinguishment within the specific limits of items allowed in testing. Fire suppression performance is determined by extinguishing specific types of fires within specific limits of time. Test types and time limits are determined by testing agencies such as Underwriters Laboratories (UL) and Factory Mutual (FM). Tests are divided into two main hazards: Class-A and Class-B fires. Class-A fires are based upon wood based products and polymer (plastic) materials. Class-B fires are based upon liquid petroleum derived substances.

Standards established by UL and FM have heretofore mandated that the standard discharge time for a clean agent such as Halon 1301 which is contained in the storage vessels of a particular fire suppression system be completely discharged through the orifices of respective distribution nozzles in a time period of from about 6 to 10 seconds. All testing by UL and FM requires a nominal 10 second discharge time at 70° F. (plus or minus) 5° F. Suppressant agent discharge time in this context and as used herein means the time interval from first arrival of the liquified gaseous agent at a nozzle until such time as 95% of the liquid has been exhausted and delivered from the nozzle as a gaseous product. It is known in this respect that each nozzle opening should not exceed about 80 to 85% of the area of the inside of the liquid delivery pipe connected to that nozzle. Otherwise, the piping is controlling the flow and not the nozzle.

Each manufacturer tests its specific agent delivery system of hardware, nozzles and amount of agent and specifies its own physical limits for each fire type when testing before UL and FM. Extinguishment tests time limits can be anywhere from 30 seconds to 10 minutes after the end of agent discharge. Tests with Class-B materials such as a heptane pan fire must be extinguished within 30 seconds after the end of discharge of the suppressant agent.

The 6 second time interval had its genesis in restricting the outflow of Halon 1301 from the distribution nozzles to a velocity such that the gaseous suppressant discharge from the nozzles did not tend to blow off ceiling tiles conventionally provided in enclosed areas requiring fire protection. If the discharge of Halon from the system had been permitted to be fully exhausted in a time significantly less than 6 seconds, it was believed that the velocity of such gas discharge would have been sufficiently high to deleteriously effect the environs of the protective room or enclosure and especially relatively easily dislodged items such as supported ceiling tile held in place only by gravity.

With a limit of 6 seconds having been determined to be a minimum for reasonably safe discharge time of the suppressant, 10 seconds was established by the testing authorities as the maximum time for suppressant discharge permitted within the standards, on the basis that delivery of the suppressant to the hazard should be accomplished as quickly as feasible in order to obtain necessary fire extinguishment in accordance with test standards.

Authorized fire suppressant testing authorities have promulgated test requirements for fire suppressant agents including Halon 1301 for approved use in specific applications. For example, a suppressant agent to meet the requirements for suppressing a Class B fire must show that a designated amount of the suppressant agent applied in a manner and under conditions established by the test procedure will extinguish a heptane pan fire within 30 seconds when the suppressant agent is discharged within a maximum 10 second period. Class A wood crib fires must be extinguished in accordance with the test protocol in 10 minutes following a maximum 10 second suppressant discharge time. In a polymer material Class A test, the polymeric material must be extinguished within 10 minutes following the maximum 10 second suppressant discharge time.

Based on the standardized tests conducted with Halon 1301 as a suppressant for Class A and Class B fires, computer programs have long been available to installers of Halon 1301 based fire suppression systems for determining the amount of the Halon 1301 suppressant required for a particular installation, the number and location of nozzles necessary for the protected space, and the entire piping system, including size of pipe and distribution of the piping components which will provide an approved system for that location.

It has been found that $CF_3CHF_2$, known generically as "HFC-125" offers fire suppression properties similar to Halon 1301 without the attendant environmental problems that have developed as a result of the use of Halon 1301. Class A and Class B fire extinguishment tests conducted with HFC-125 have shown though that somewhat larger quantities of HFC-125 must be made available than is the case where Halon 1301 was used as the suppressant, especially for Class B pan fires and Class A polymer fires.

Even though the suppressant agent discharge time is increased beyond what has previously been deemed to be the standard discharge period, tests have established that HFC-125 when discharged through an existing Halon 1301 piping system can extinguish both Class A and Class B fires in accordance with approved Class A and Class B fire extinguishment procedures using what amounts to a commercially feasible additional quantity of HFC-125.

Employing the data obtained from testing extinguishment of Class A and/or Class B fires using HFC-125 and causing the HFC-125 suppressant agent to be fully discharged into the area of the test fire in a time period in excess of 10 seconds and up to about 25 seconds, the data generated from the tests has been relied upon to develop a new computer program available from the assignee hereof which calculates the amount of HFC-125 required to extinguish either a Class A and/or Class B fire that may arise in an area requiring protection and using an existing piping system . This computer program allows a fire suppression system installer charged with responsibility for retrofitting an existing Halon 1301 based fire suppression system, where HFC-125 is to be substituted for Halon 1301, to determine how much additional HFC-125 may be required over the approved amount of Halon 1301 to extinguish a fire under the same time period constraints as have been previously applied to Halon 1301 systems.

Insertion of the test data in the HFC-125 dependant software program along with diagram generated information outlining details of the construction and arrangement of an existing piping system, including pipe materials, pipe diameter, number and location of pipe connections allows the operator to establish how much HFC-125 will be required, the size and number of vessels needed to store the full quantity of the suppressant agent for the fire suppression system being retrofitted, and nozzle parameters.

The computer program solves for the amount of HFC-125 necessary to fulfill the requirements of a particular fire suppression installation. When discharge times exceed 10 seconds, the additional amount of HFC-125 required for performance equivalent to a 6 to 10 second discharge may be expressed by the formula $C_+=((T_D-10)/(2\times T_{CRIT})-T_D\times 100)$ where $C_+$ is the additional percentage on a weight basis of fire suppression agent needed for fire extinguishing performance at least about equivalent to the use of Halon 1301, $T_{CRIT}$ is the critical average time span required for material to be extinguished, and $T_D$ is the time of total discharge of HFC-125 from the system.

This invention relates to a retrofitted Halon 1301 system in which HFC-125 is substituted for Halon 1301 using the existing piping distribution, to methods of retrofitting existing Halon 1301 systems substituting HFC-125 for Halon 1301 and to methods of designing and installing new systems based on the use of HFC-125 in lieu of Halon 1301.

The method of this invention permits retrofitting of existing Halon 1301 suppressant agent systems with a minimum extinguishing concentration of the agent taking into account a requisite safety factor as required by a controlling regulatory authority and without change in the piping of the existing system.

BRIEF DESCRIPTION OF THE DRAWINGS

The FIG. 1 drawing is a flow diagram representation of the calculations carried out by a preferred computer program which facilitates retrofitting of an existing Halon 1301 based fire suppression system in which HFC-125 is substituted for Halon 1301.

DETAILED DESCRIPTION OF THE PREFERRED EMBODIMENTS

Figure 1:
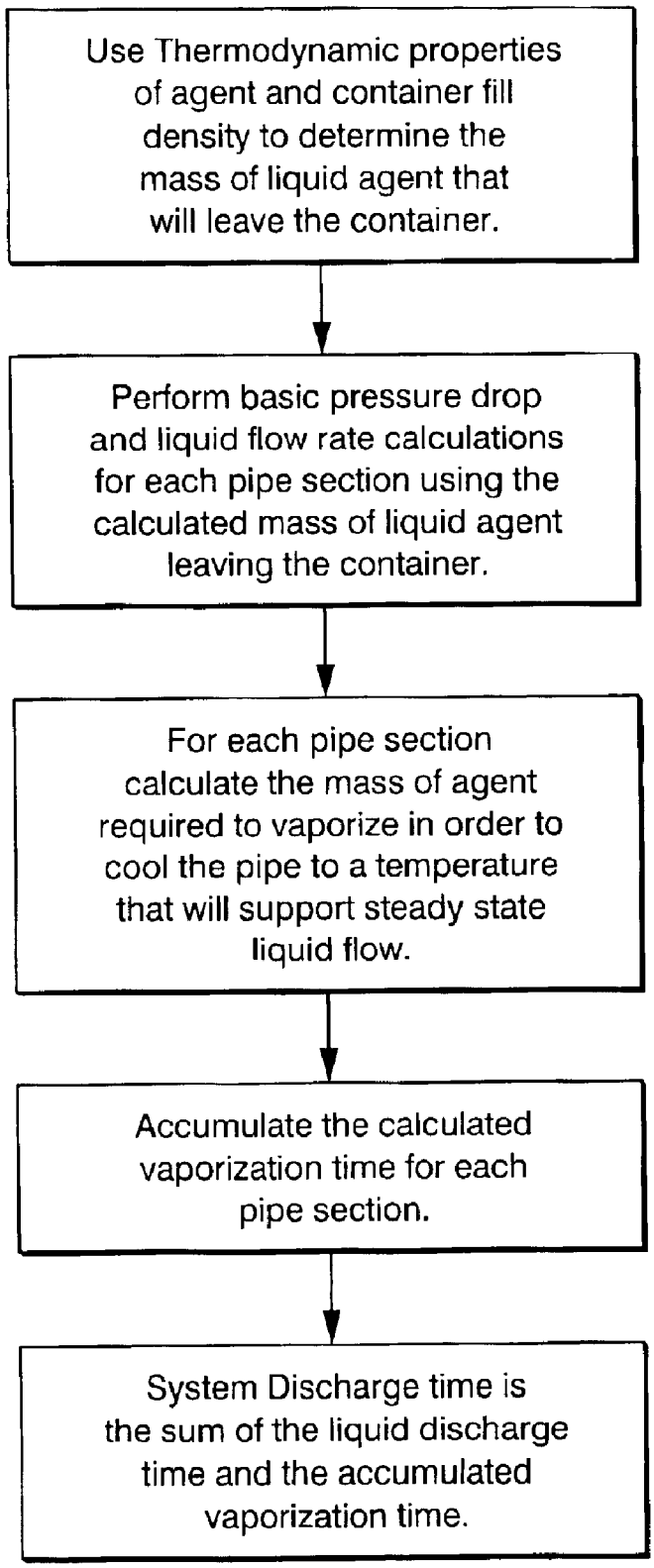

This invention concerns extending the agent discharge time from previously mandated 6 to 10 second discharge time to a time interval of in excess of ten seconds to about 25 seconds, thus to accommodate for the decreased flow rate characteristics of HFC-125 and to provide the necessary additional suppressant agent required to meet the approved fire suppressant tests. Because HFC-125 is more costly than Halon 1301, it is necessary to accurately determine the specific amount of HFC-125 which must be released into the area to be protected within a time such that the discharge agent will extinguish a Class-A and/or Class-B fire depending upon whether Class-A and/or Class-B or both test standards must be met.

By conducting actual fire tests, the amount of HFC-125 required to extinguish Class A polymer, Class A crib and Class B pan fires, may be determined using the standard test Class A and Class B fire protocols established by UL and FM. These tests have shown that with pan fires when comparing standard Halon 1301 clean agent concentrations against the same concentration of BFC-125 but with a longer than standard agent discharge time, i.e., of the order of 20 seconds, provision of an additional 6% of HFC-125 resulted in fire extinguishment within 30 seconds, totaling 50 seconds. Similar test results with wood crib fires established that HFC-125 at a concentration equivalent to Halon 1301 standard concentration is sufficient for extinguishment of a crib fire and which prevents re-ignition during the allotted standard 10 minutes fire extinguishment test using the same concentration of HFC-125. Tests of polymers (PMMA) have shown a need for somewhat greater agent concentration than used for Halon 1301 for standard 10 minute fire suppression times with a 20 second discharge period. Clean agent concentrations were adjusted for equivalent 10 second discharge suppressant times.

Both wood cribs and polymers are Class A materials and therefore suppressant agent concentrations require that worst case agent concentration be used for all Class A tests. Thus, the suppressant agent concentration for wood cribs is always excessive because of relatively high concentrations required for polymer fire tests.

The studies were based upon average clean agent room concentration over a 40 second test period. The resultant data showed a good relationship between "average clean agent room concentration" and extinguishment times. This relationship was found to exist when both large and small fires were lit in the same size room. It was determined that each fire type, test setup, and extinguishment time has an impact upon the relationship of the agent discharge time and room concentration time required. In view of the fact that an added amount of HFC-125 is needed as compared with Halon 1301 supplied though the piping of existing Halon based suppressant systems, average clean agent room concentration, extinguishment time and discharge time must be correlated in a manner that allows a reliable prediction of the amount of agent required, for a given hazard, for fire suppression performance equivalent to that of Halon 1301.

Extending the agent suppressant discharge time from 10 seconds to, for example, 20 seconds requires that additional suppressant agent be provided to meet the 30 second Class-B extinguishment test requirement. This is attributable to the average agent concentration in the test cell being lower during the 30 seconds allowed for extinguishment.

It was unexpectedly found that Class-A tests required additional agent to meet the 10-minute extinguishment requirement. The HFC-125 discharged into the test cell during the first 20-seconds of the test allowed at least 9 minutes and 50 seconds for extinguishment to occur. Testing standards specify extinguishment will occur 10 minutes following the end of (a 10 second) discharge and therefore only 10 minutes was allowed past the initial 10 second time period of the standardized testing protocol. The Class A 10 minute tests did not result in extinguishment within allowed time limits, even though the average agent concentration over the 10 minute test exceeded 98% of the same average agent concentration of a Class B standard 10 second discharge, 30 second extinguishment test.

These tests results established that there is a previously unknown and underlying relationship between discharge time and average agent concentration which must be defined to predict agent concentrations required for systems with extended discharge times beyond 10 seconds. This relationship exists for all types of tested materials and even those fire types that are allowed 10 minutes to extinguish.

The average agent concentration in the room during the early portion of the fire suppression event is the prevailing and crucial factor. The critical time period in which this average agent concentration is directly related to extinguishment time is known as $T_{CRIT}$. The time over which this $T_{CRIT}$ is computed is critical when predicting the amount of agent required. $T_{CRIT}$ is defined as the critical averaging time span for a specific material to be extinguished. This critical time span determines the actual increase in agent concentration when discharged over a time period of from 10 to 25 seconds providing equivalent performance when compared to a 10 second Halon 1301 discharge system.

In order to assess the additional amount of HFC-125 required as a substitute for Halon 1301 in an existing Halon 1301 based system in which the agent discharge time is extended beyond the heretofore standard 10 second maximum discharge time to a discharge time in excess of 10 seconds and up to about 25 seconds, it was found necessary to determine a critical time-averaging period for each fire type. For fire-test-cell purposes the critical time span governing average agent concentration is different for each fire type.

For a specific Class A or Class B test $T_{CRIT}$ must be determined. A fire test cell and various Class A and Class B material were burned and extinguished using extended discharge time of approximately 20 seconds. Agent concentrations were adjusted such that equivalent extinguishment times were achieved. These test results disclosed the actual relationship of $T_{CRIT}$ with respect to extended discharge times. Since extinguishment times and the required agent concentrations are well known for 10 second discharge, $T_{CRIT}$ may be expressed using the 10 second standard agent concentrations as a baseline.

Given any specific fire extinguishment test that results in both the extended discharge and standard discharge extinguishment times being approximately equal, the following preferred formula has been found to predict the critical averaging time span $T_{CRIT}$:

$$T_{CRIT}=0.5\times(((T_D-10)/(C_+/100))+T_D) \quad \text{[I]}$$

Where:

$T_D$ is the time of extended agent discharge

The constant 10 is based upon a standard 10-second discharge for traditional systems.

$T_{CRIT}$ is the critical averaging time span for the specific material to be extinguished.

$C_+$ is the additional percentage (percent change) of agent concentration needed for equivalent 10-second discharge performance.

Based on tests conducted as described, it has been determined that the critical averaging time span is no more than about 100 seconds in the case of Class A polymers (PMMA) and usually does not exceed about 85 seconds. The average critical time span for Class B fuels (heptane pan) has been found to not exceed about 60 seconds and is usually not more than about 50 seconds.

The additional amount of HFC-125 required for fire suppression times that are equivalent to those obtained from industry standard 10 second agent discharge tests may be calculated using an agent discharge time in the range exceeding 10 seconds and up to about 25 seconds in accordance with the formula:

$$C_+=((T_D-10)/(2\times T_{CRIT})-T_D\times 100) \quad \text{[II]}$$

where $C_+$ is the additional percentage on a weight basis of fire suppression agent needed for fire extinguishing performance at least about equivalent to the use of Halon 1301, $T_{CRIT}$ is the critical average time span required for the material to be extinguished, and $T_D$ is the time of total discharge of HFC-125 from the system.

Upon rearrangement of formula [II] to solve for $T_{CRIT}$, the following generalized equation results:

$$T_{CRIT}=0.Y\times((T_D-10)/(C_+/100))+T_D \quad \text{[III]}$$

wherein Y is a number within the range of from about 0.3 to about 0.7, preferably from about 0.4 to about 0.6 and most preferably about 0.5.

EXAMPLES 1 AND 2

A 10-second discharge test was conducted using a Class-A polymer such as ABS plastic. The required agent concentration in the test cell was 7% by volume. The fire extinguished at the 10-minute time limit.

A 22-second discharge test was conducted using the same Class-A polymer ABS plastic. The agent concentration was increased to 7.4% by volume. The fire also extinguished at the 10minute time limit.

Both tests resulted in extinguishment at the same time and only the agent concentration and agent discharge time changed. Therefore, formula [I] can be applied to determine the critical averaging time span for the ABS plastic.

Since C+ represents the additional percentage (percent change) of agent concentration for equivalent 10-second discharge performance:

$$C+=((7.4\%/7.0\%)-1)\times 100=6\% \text{ increase.}$$

Thus:

$$T_{CRIT}=0.5\times(((T_D-10)/(C_+/100))+T_D)$$

$$T_{CRIT}=0.5\times(((20-10)/(6\%/100))+20)$$

$$T_{CRIT}=93.3 \text{ seconds}$$

Once $T_{CRIT}$ is known, then $C_+$ can be determined for fire suppression performance using HFC-125 as compared with an equivalent Halon 1301 system. Because an HFC-125 system with an extended discharge system from about 10 to about 25 seconds requires more agent be added based on the length of the discharge time, the final determination of the length of discharge time and the amount of agent is an iterative process. That is, the longer the agent discharge time, the more additional HFC-125 agent is needed and the more HFC-125 is needed, the longer the discharge time. This iterative process should be continued until the resulting amount (error) in the calculation becomes a negligible amount.

In accordance with this invention, if retrofitting of an existing Halon 1301 suppressant agent system is to be carried out in a jurisdiction where agent discharge times in the range exceeding about 10 seconds and up to about 25 seconds as opposed to standard 6 to 10 second discharge times have not previously been approved, the first step will be to obtain the required regulatory approval in that jurisdiction by conducting the necessary tests using HFC-125 pursuant to approved fire extinguishment tests for Class A and/or Class B fires. These tests should be carried out as described using iterative suppressant agent discharge times each in the range exceeding 10 seconds and up to about 25 seconds. These tests will then provide the critical averaging time span for each of Class A and Class B fires.

A computer software program identified as the Fike ECARO-25™ program may be obtained from Fike Corporation, Blue Springs, Mo., USA, for use by installers in retrofitting existing Halon 1301 systems in accordance with the method hereof for substitution of HFC-125 for the Halon 1301 without changing the piping system. The Fike ECARO-25 program carries out calculations using incorporated look up tables pursuant to the flow diagram illustrated in Drawing FIG. 1.

One screen of the Fike ECARO-25 program permits the user of the program to input a schematic representation and data regarding an existing piping system including the piping components, their dimensions and characteristics and the specific arrangement of the piping and connecting elements, and nozzles. The installer may obtain this piping information either from a the user or the original installer of the Halon 1301 system.

Upon entry of the identity of HFC-125 in the computer program as the liquefied suppressant agent to be used in retrofitting of the existing Halon 1301 fire suppression system, the program through an appropriate lookup table uses the thermodynamic properties of the HFC-125 and container fill density to determine the mass of liquid agent that will leave the supply container. The program also performs basic pressure drop and flow rate calculations for each pipe section and connector using the calculated mass of liquid agent leaving the container. The software program further calculates the mass of agent required to vaporize in order to cool each pipe section to a temperature that will support steady state of liquid flow. The program also accumulates a calculated vaporization time for each pipe section. The system discharge time, $T_D$ in Equation [I] as determined by and used the computer program is the sum of the liquid discharge time and the accumulated vaporization time. As an output, the computer program tells the installer how much HFC-125 is required to meet the applicable government regulation, plus a safety factor for the system to be retrofitted or built new.

EXAMPLE 3

If it is determined that for a given room volume, 1000 lbs. of HFC-125 must be delivered to that room within the conventional maximum time of 10 seconds in order to obtain a necessary concentration of suppressant agent in the room, a piping arrangement that was installed to deliver a requisite amount of Halon 1301 to the room would in fact restrict the flow of the HFC-125 such that agent discharge time would be of the order of 15 seconds rather than 10 seconds. After input of the parameters of the piping system into the Fike ECARO-25 computer program, the program carries out an iterative process to provide the installer with information regarding the additional amount of HFC-125 that must be furnished at the most efficient agent discharge time.

An iterative calculation process in accordance with equations I and II performed using the inputs described in this example is performed until the residue "error" results in less that 1 lb. agent differential.

The following table is illustrative of this iterative process:

| Step | Disch. time est. | C+ | Add'l Agent | New Calc. time | Add'l time Req. | Agent Req. |
|---|---|---|---|---|---|---|
| 1 | 15 seconds | 3.31% | 3.31%/33.1# | 15.495 sec. | .495 sec. | 1033.1# |
| 2 | 15.495 seconds | 3.65% | .0341%/3.52# | 15.548 sec. | 0.053 sec. | 1036.62# |
| 3 | 15.549 seconds | 3.68% | 0.030%/0.31# | (Stop Iteration - error is less than 1# agent | | |

In most cases, the amount of HFC-125 required as a substitute for Halon 1301 in a system where the existing piping is to be left in place, will not usually exceed an amount greater than about 1.3 to about 1.6 times the amount of Halon 1301 in the existing system calculated on a weight basis.

We claim:

1. In a method of converting an existing fire suppression system that initially utilized Halon as a fire suppressant agent to protect a room or other enclosure and including a piping system having a plurality of existing distribution pipes leading to and operatively coupled with respective distribution nozzles, a selectively openable reservoir containing a first amount of pressurized Halon fire suppressant agent, said reservoir operatively coupled with said distribution pipes and normally operable, in response to fire conditions within said room or enclosure, to exhaust said Halon fire suppression agent into and through said distribution pipes and respective nozzles in a time from about 6 to about 10 seconds, said method comprising:

providing a selectively openable container holding a second amount of pressurized HFC 125 fire suppressant agent greater than said first amount of Halon, said container being operatively coupled with said existing distribution pipes;

pressurizing said amount of HFC 125 fire suppressant agent in the container to a level sufficient to exhaust said second amount of HFC 125 through said existing distribution pipes and out said respective nozzles in a time range of from about 10 to 25 seconds; and analyzing the suppression agent flow properties and characteristics of the existing Halon fire suppression system to determine the time-to-discharge ($T_D$)of Halon from the system, and determining said amount of HFC 125 fire suppression agent to be added to the container in accordance with the formula $C_+=((T_D-10)/(2\times T_{CRIT})-T_D\times 100)$ where $C_+$ is the additional percentage on a weight basis of fire suppression agent needed for fire extinguishing performance equivalent to said amount of Halon in the system, $T_{CRIT}$ is the critical average time span for material required to be extinguished, and $T_D$ is the time of total discharge of HFC 125 from the system, a sufficient amount of HFC 125 being provided in the container to such that the suppressant agent meets standard Class A or Class B fire extinguishment tests when exhausted from the container.

2. In a method of converting an existing Halon-based fire suppression system to use of a HFC 125 fire suppression agent in lieu of Halon as set forth in claim 1, wherein is included the step of providing an amount of HFC 125 fire suppression agent which is from about 10 percent to 25 percent greater than said amount of Halon provided in the system.

3. In a method of converting an existing Halon-based fire suppression system to use of a HFC 125 fire suppression agent in lieu of Halon as set forth in claim 1, wherein is included the steps of determining $T_{CRIT}$ in accordance with the formula $T_{CRIT}=0.Y\times((T_D-10)/(C+/100))+T_D$ wherein Y is a number within the range of from about 0.3 to about 0.7.

4. In a method of converting an existing Halon-based fire suppression system to use of a HFC 125 fire suppression agent in lieu of Halon as set forth in claim 1, wherein in Y is a number within the range of from about 0.4 to about .0.6.

5. In a method of converting an existing Halon-based fire suppression system to use of a HFC 125 fire suppression agent in lieu of Halon as set forth in claim 1, wherein in Y is from about 0.5.

6. In a method of converting an existing Halon-based fire suppression system to use of a HFC 125 fire suppression agent in lieu of Halon as set forth in claim 1, wherein $T_{CRIT}$ is a time not exceeding about 100 seconds for an amount of HFC 125 which meets Class A fire extinguishment tests.

7. In a method of converting an existing Halon-based fire suppression system to use of a HFC 125 fire suppression agent in lieu of Halon as set forth in claim 1, wherein $T_{CRIT}$ is a time not exceeding about 85 seconds for an amount of HFC 125 which meets Class A fire extinguishment tests.

8. In a method of converting an existing Halon-based fire suppression system to use of a HFC 125 fire suppression agent in lieu of Halon as set forth in claim 1, wherein $T_{CRIT}$ is a time not exceeding about 60 seconds for an amount of HFC 125 which meets Class B fire extinguishment tests.

9. In a method of converting an existing Halon-based fire suppression system to use of a HFC 125 fire suppression agent in lieu of Halon as set forth in claim 1, wherein $T_{CRIT}$ is a time not exceeding about 50 seconds for an amount of HFC 125 which meets Class B fire extinguishment tests.

10. In a method of converting an existing Halon-based fire suppression system to use of a HFC 125 fire suppression agent in lieu of Halon as set forth in claim 1, wherein said HFC 125 is pressurized to a sufficient pressure to effect exhaustion of HFC 125 from the system in no more than about 20 seconds.

11. In a method of converting an existing Halon-based fire suppression System to use of a HFC 125 fire suppression agent in lieu of Halon as set forth in claim 1, wherein said HFC 125 is present in amount equal to about 1.7 times the amount of Halon initially present in the system calculated on a weight basis.

* * * * *